US009211436B1

(12) United States Patent
Torres

(10) Patent No.: US 9,211,436 B1
(45) Date of Patent: Dec. 15, 2015

(54) 4 GUNS TOWER DUMBBELL SYSTEM

(71) Applicant: Tomas Torres, Palm Bay, FL (US)

(72) Inventor: Tomas Torres, Palm Bay, FL (US)

( * ) Notice: Subject to any disclaimer, the term of this patent is extended or adjusted under 35 U.S.C. 154(b) by 249 days.

(21) Appl. No.: 13/998,701

(22) Filed: Apr. 5, 2013

(51) Int. Cl.
*A63B 21/072* (2006.01)
*A63B 21/055* (2006.01)
*A63B 23/035* (2006.01)

(52) U.S. Cl.
CPC ..... *A63B 21/072* (2013.01); *A63B 21/0552* (2013.01); *A63B 23/03508* (2013.01)

(58) Field of Classification Search
CPC combination set(s) only.
See application file for complete search history.

(56) References Cited

U.S. PATENT DOCUMENTS 4,231,569 A * 11/1980 Rae ..... A63B 23/1281 482/108
4,607,840 A * 8/1986 Harper ..... 482/109
5,350,345 A * 9/1994 Frey ..... 482/105
5,540,640 A * 7/1996 Povilaitis ..... 482/108
5,573,484 A * 11/1996 Carpenter ..... 482/108
2012/0225757 A1* 9/2012 Kosich ..... 482/105
2014/0135186 A1* 5/2014 Reynolds et al. ..... 482/108
2014/0274598 A1* 9/2014 Anderson ..... 482/108

* cited by examiner

*Primary Examiner* — Loan H Thanh
*Assistant Examiner* — Jennifer M Deichl
(74) *Attorney, Agent, or Firm* — Ferraiuoli LLC; Eugenio J. Torres

(57) ABSTRACT

A dumbbell system for exercising different parts of the body including the biceps, triceps, chest, legs and more. The dumbbell system provides a different look and intensity of the work out during use when compared with other regular dumbbell systems. The present disclosure provides a dumbbell system comprising a handle, towers and a weight, wherein said weight is positioned far forward the handle. The dumbbell system increases the force to lift this apparatus, is such way that 10 pound dumbbell may require approximately 20 pounds of force to complete the move of said dumbbell. Further the towers are extended from the handle assisting with reaching said dumbbell while working out. For example, when doing a seated exercise on the bench, you don't have bend down to the floor, risking an injury on your lower back. Also the dumbbell system comprises easily removable iron plate by pulling up a pin on the edge of the plates; the weights can slide out in few second.

6 Claims, 17 Drawing Sheets

4 GUNS TOWER DUMBBELL SYSTEM

STATEMENT REGARDING FEDERALLY SPONSORED RESEARCH AND DEVELOPMENT

N/A

RELATED APPLICATIONS

N/A.

BACKGROUND OF THE INVENTION

1. Field of the Invention

The present invention is generally directed to a dumbbell system to work out.

2. Discussion of the Background

Currently elastic bands provide a negative phase that no other equipment had been capable to achieve. Therefore is a need to provide a system for providing a negative weight without the use of elastic bands.

SUMMARY OF THE INVENTION

The present invention overcome the shortcomings of the elastic bands and in accordance with the principles of the present disclosure provides a dumbbell system including weights producing a negative force. For example, the current dumbbell system provides a negative force or resistance that will still in effect even at the top of the movement, which will be 12 o'clock, the negative resistance is still fighting you every second of the range of motion. Like the elastic band, increases the resistance of the towers moving it away from the floor and making contact with the forearm. The result is faster, gaining strength, power, and muscle mass, than traditional dumbbells ever could.

An object of the present disclosure in to provide a dumbbell system that increase the resistance of the dumbbell while working out. In accordance with the principles of the current disclosure the first exemplary embodiment of the dumbbell system comprises a handle, towers and a weight, wherein said weight is positioned away from the handle in order to increases the force to lift this apparatus. The result is faster, gaining strength, power, and muscle mass, than traditional dumbbells ever could Another object of the present disclosure is to provide a dumbbell system easy to pick up while working out. In accordance with the principles of the current disclosure the first exemplary comprises at least a pair of towers connecting the handle with a bar or floating ring rack supporting the weight or floating ring, wherein said tower is shaped to hold the weight having a grip handle higher than the weight.

Another object of the present disclosure is to provide a continues tension on your working muscle and make sure the weights you are using are travelling vertically even if your arms are in circular motion. In accordance with the principles of the current disclosure the first exemplary embodiment of the dumbbell system comprises a forearm rest body to assists the continues tension on the working muscle.

Yet another object of the present disclosure is to provide a removable weight or floating ring. In accordance with the principles of the current disclosure the first exemplary embodiment of the dumbbell system comprises a sliding floating ring with a pin to locked said sliding floating ring to said floating ring rack.

A further understanding of the nature and advantages of the present invention will become apparent by reference to the examples provided.

DETAILED DESCRIPTION OF THE DRAWINGS

Figure 1:
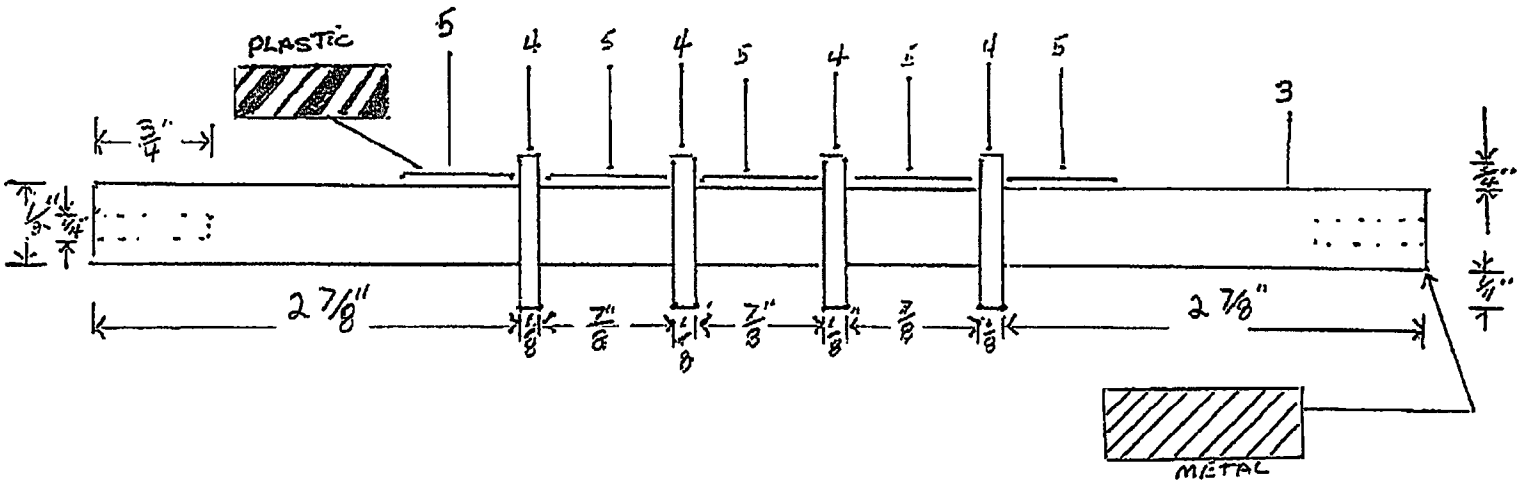
FIG. 1 shows a front view of the floating ring rack in accordance with the principles of the present disclosure.

The dumbbell system comprises a floating ring rack 3, at least two towers plates 10, a forearm rest body 9, a grip handle 11 and at least a floating ring 1. The towers are separate and attached to the forearm rest body 9, a grip handle 11 and floating ring rack 3. In accordance with the principles of the present disclosure the floating rings 1,2 are added or removed from the floating ring rack 3 by means of first end cap 15, second end cap 17 and locking pins 8. Further the dumbbell system comprises two types of floating rings: the sliding floating ring 1 and stationary floating ring 2.

Figure 2:
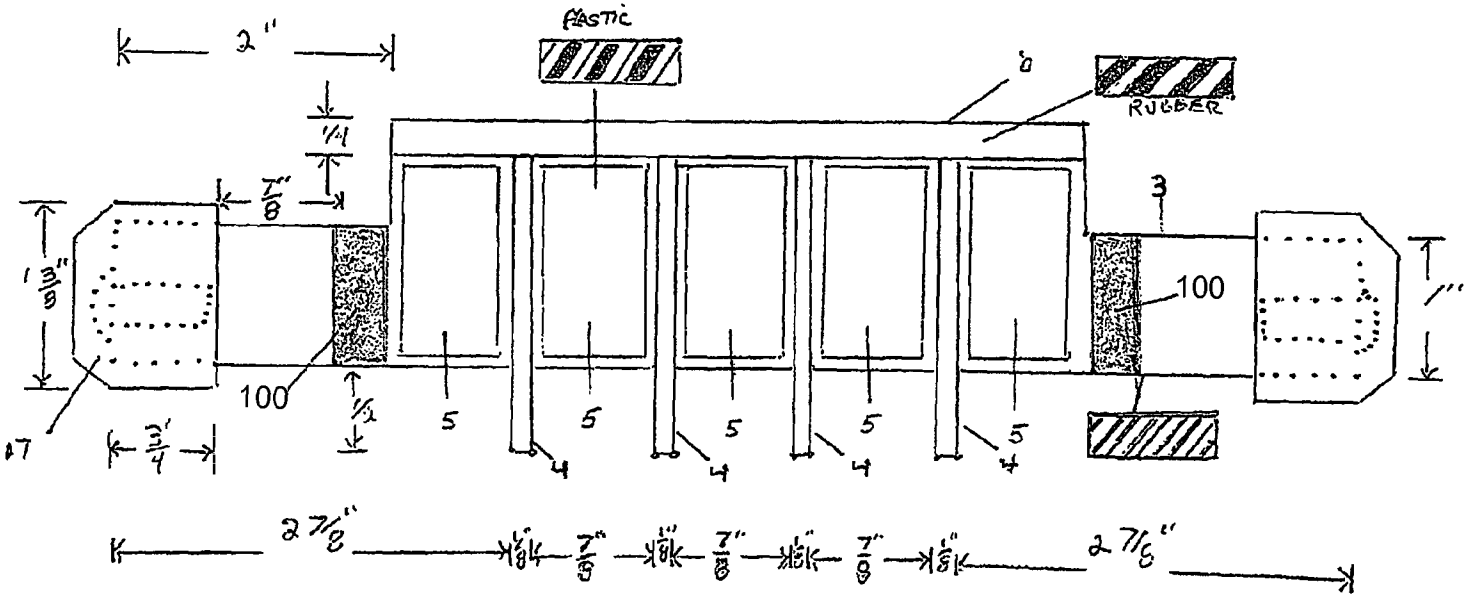
FIG. 2 shows a top view of the floating ring rack in accordance with the principles of the present disclosure.

FIG. 1 is directed to the floating ring rack 3. The floating ring rack 3 is the pan that holds the weight or floating rings 1,2. The stationary floating ring 1, slides on top of friction pads 5 and between the separators 4 to add or remove weight of dumbbell system. The friction pads 5 are located between the separators 4 as shown in FIG. 1. The floating ring rack 3 comprises a hard rubber pad 6 and two tower plate position areas 100, wherein each tower plate position area 100 are spaced apart by the separators 4 and friction pad 5 as shown in FIG. 2.

Figure 3:
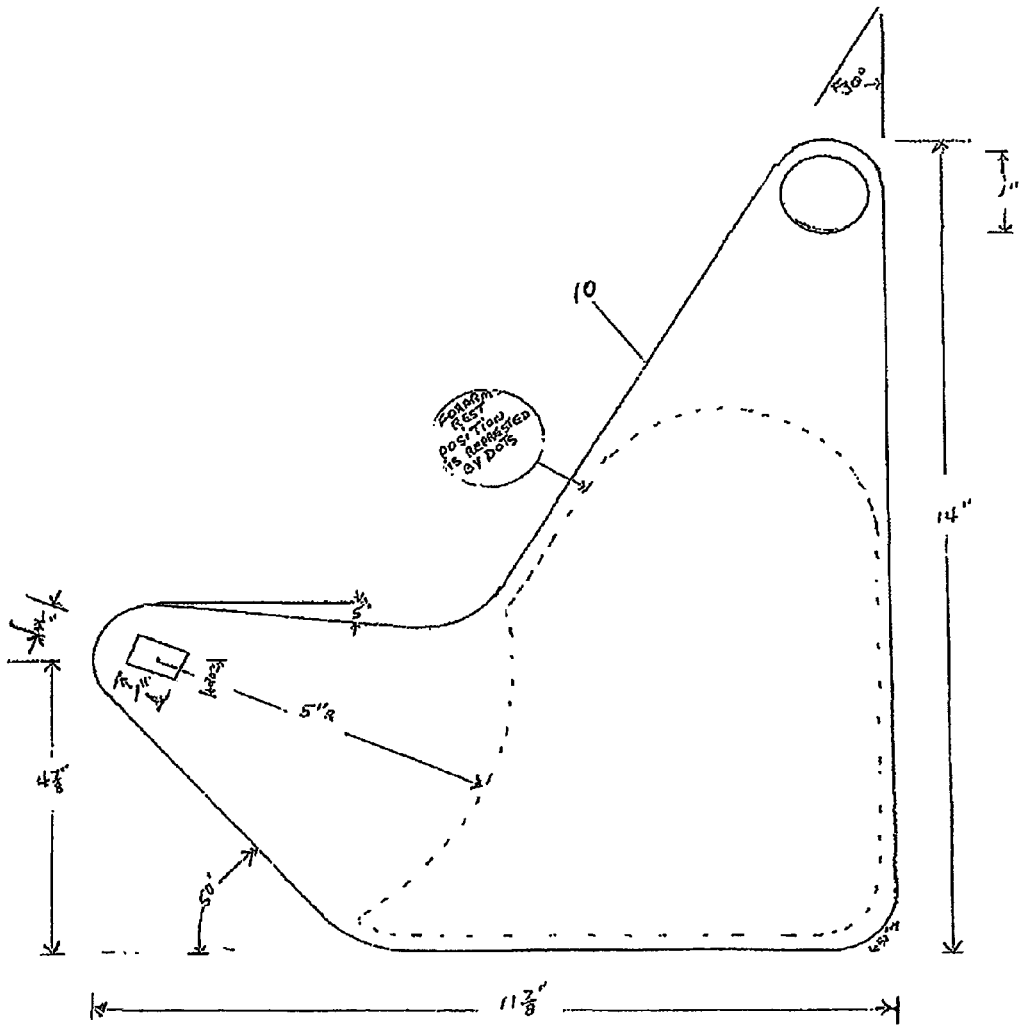
FIG. 3 shows a side view of the tower in accordance with the principles of the present disclosure.
Figures 4A, 4B:
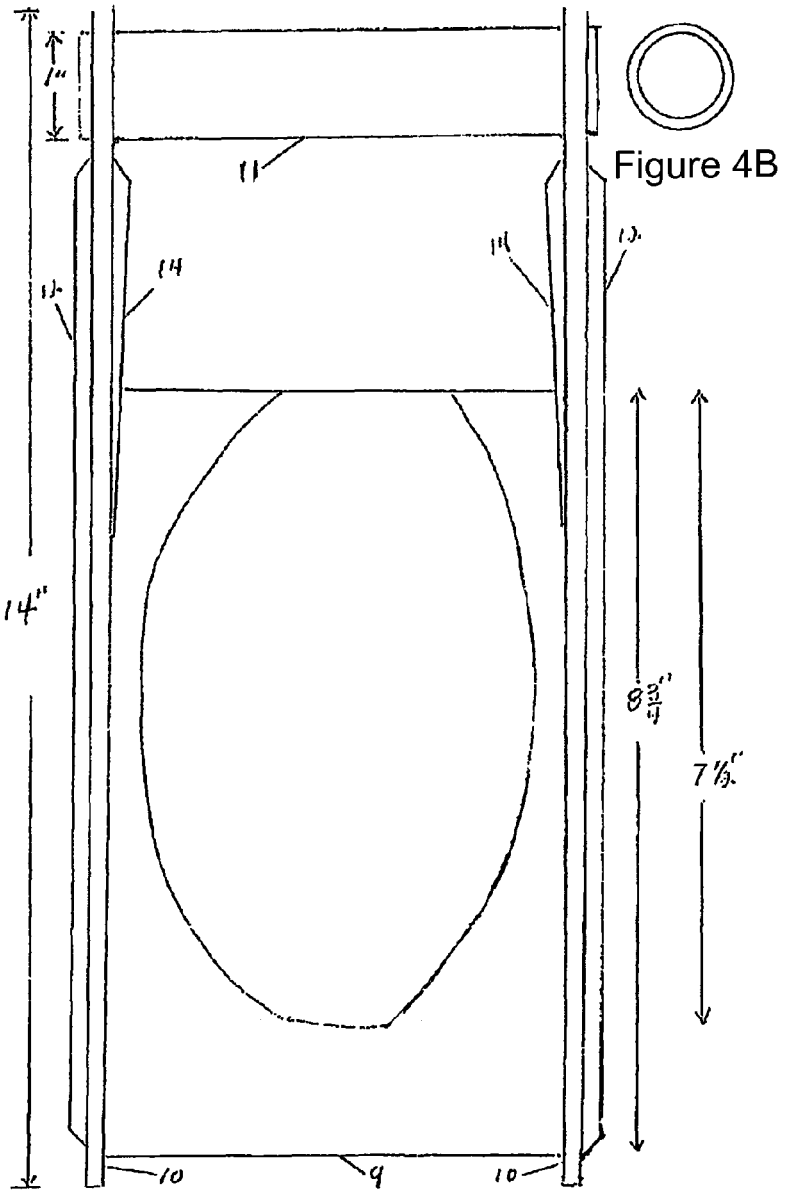
FIG. 4 shows a back view of the forearm rest in accordance with the principles of the present disclosure.
Figure 5:
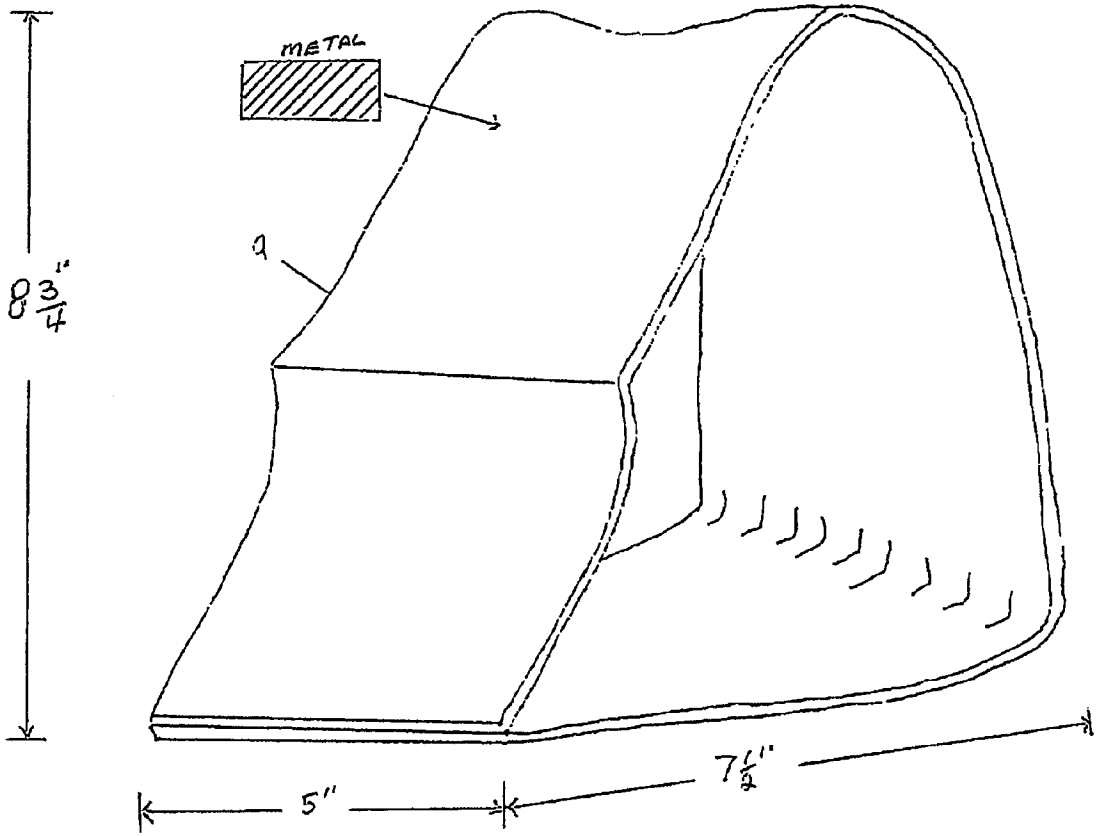
FIG. 5 shows a perspective view of the forearm rest in accordance with the principles of the present disclosure.

FIG. 3 is directed to the tower plates 10. The tower plates are the frames that hold the dumbbell system together. The tower plates 10 are coupled to the floating ring rack 3, forearm rest 9, handle 11 and inner cover. The hole on top of each plate is to accommodate handle 11 which will revolve in this hole. The rectangle opening is to accommodate floating ring rack 3. Further, as shown in FIG. 4, the forearm rest 9 is welded along the edges and situated between tower plates 10. The floating ring rack 3 distal ends are inserted through at both ends of the rectangular opening at each tower plate 10. In the center of forearm rest 9 is an indentation for comfort and stability. Preferably the forearm rest 9 is made from a sheet of metal, folded in a particular shape, as shown in FIG. 5, and welded closed at the lower front bottom edge. It is then placed in between tower plates 10 and welded in place.

Figure 6:
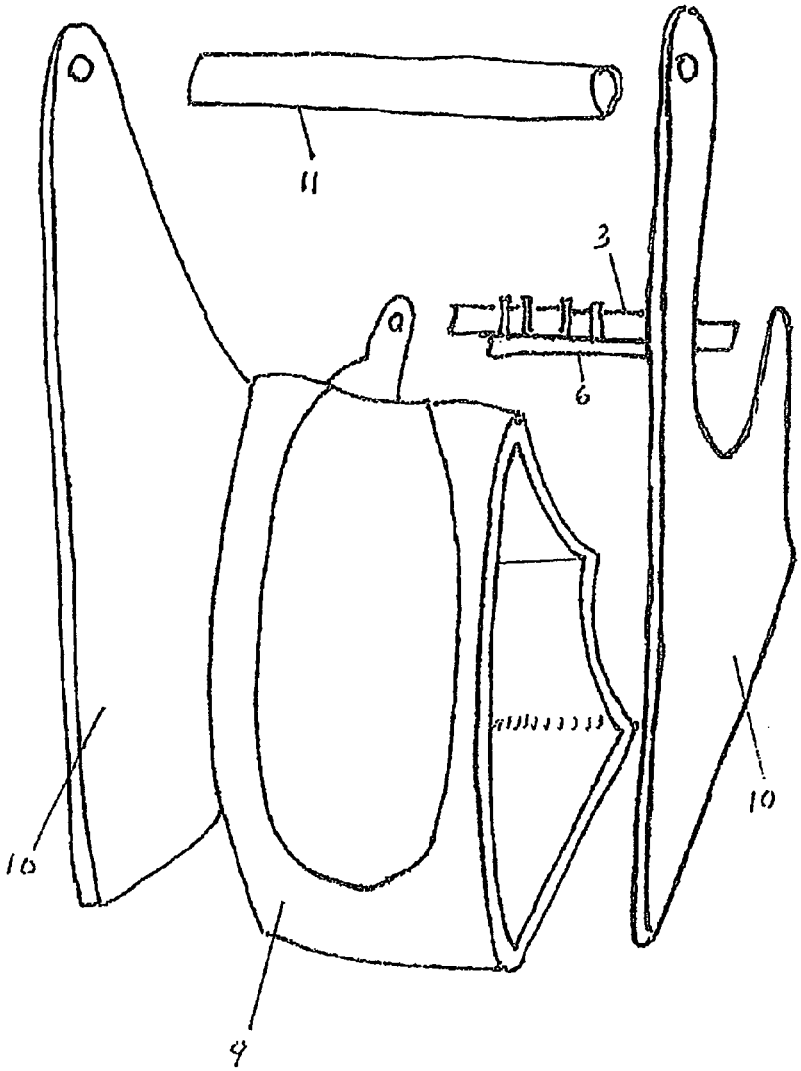
FIG. 6 shows a exploded perspective back view of the dumbbell system in accordance with the principles of the present disclosure.

FIG. 6 is directed to a perspective rear view of the dumbbell system before assembled. Clearly shows the floating ring rack 3, forearm rest 9 including an indentation, handle 11 between the tower plates 10. The forearm rest 9 has an indentation in the center so when you hold the handle grip 11 you forearm will fall there automatically and rest inside for comfort and stability as we perform the exercise that user want to do. While the user performed the exercise and holds the handle grip 11 said handle 11 is not stationary, it is preferred to be a revolving grip handle 11. A revolving grip handle 11 makes sure that there will be no stress at the user's hand as he/she hold the handle. In the preferred embodiment the handle revolves inside the round hole at the tower plate 10.

Figures 7A, 7B:
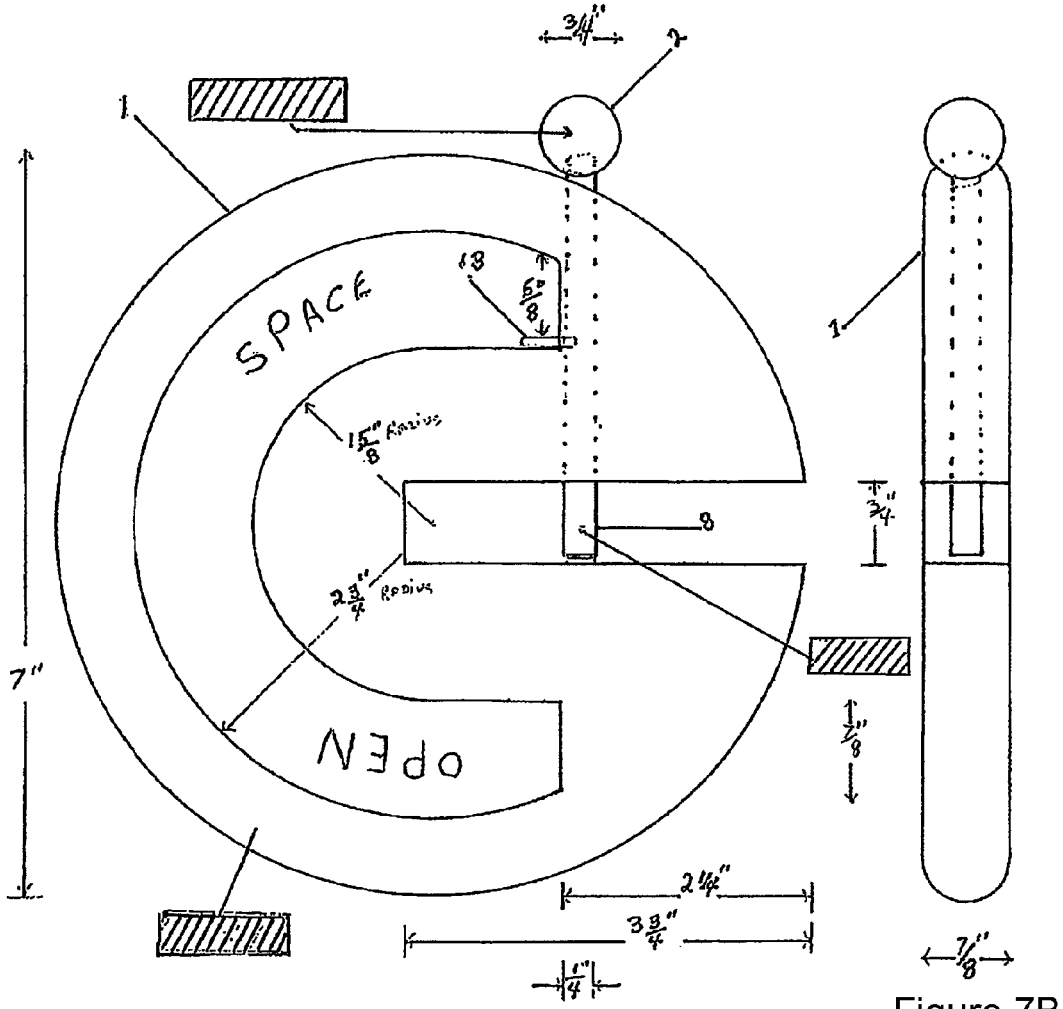
FIGS. 7A and 7B shows disclose the floating ring with locking pin for locking to the floating ring rack in accordance with the principles of the present disclosure.

FIG. 7 is directed to the sliding floating ring 1, more particularly it uses to add or remove weight of the dumbbell system. The sliding floating ring 1 slides on top of floating ring rack 3 on top of a floating ring rack plate, wherein said sliding floating ring 1 comprises a locking pin 8 on top said sliding floating ring 1, wherein said locking pin is configure to be positioned on top and through the edge of the floating ring rack plate, downwards and towards the rectangular opening located in the middle of the floating ring rack plate. This will be locked in place behind hard rubber pad 6 which is attached to floating ring rack 3. To remove the weight, just pull up the pin and slide out the sliding floating ring 1.

Figure 8A:
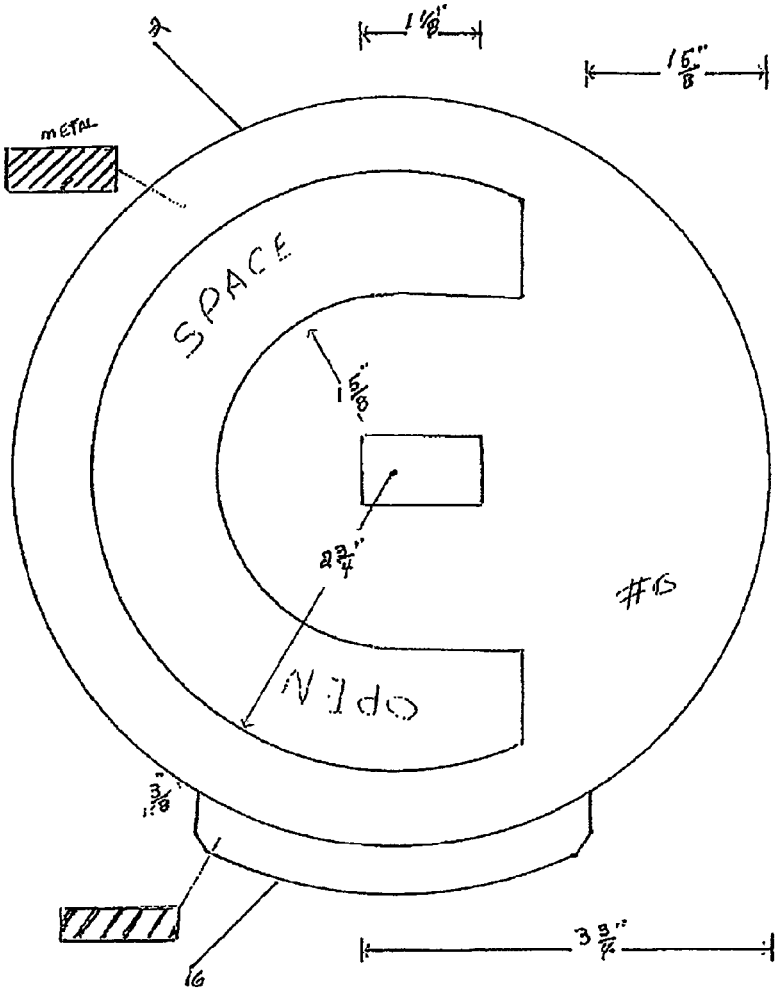
FIGS. 8A and 8B shows the stationary floating ring in accordance with the principles of the present disclosure.
Figure 8B:
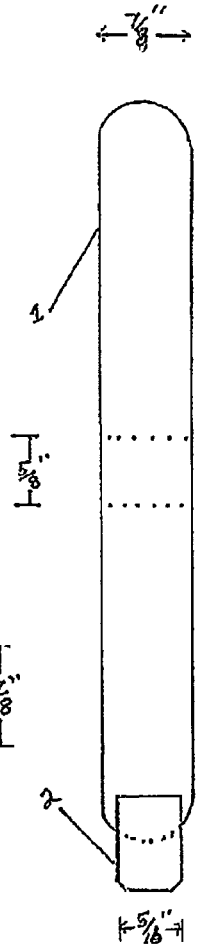

FIG. 8 is directed to the stationary floating ring 2 which is positioned at the outer side of tower plates 10 and it is screwed in place at the outer side of floating ring rack 3. There is a second hard rubber pad 16 that raises all the rings off the ground for clearance when sliding.

Figure 9B:
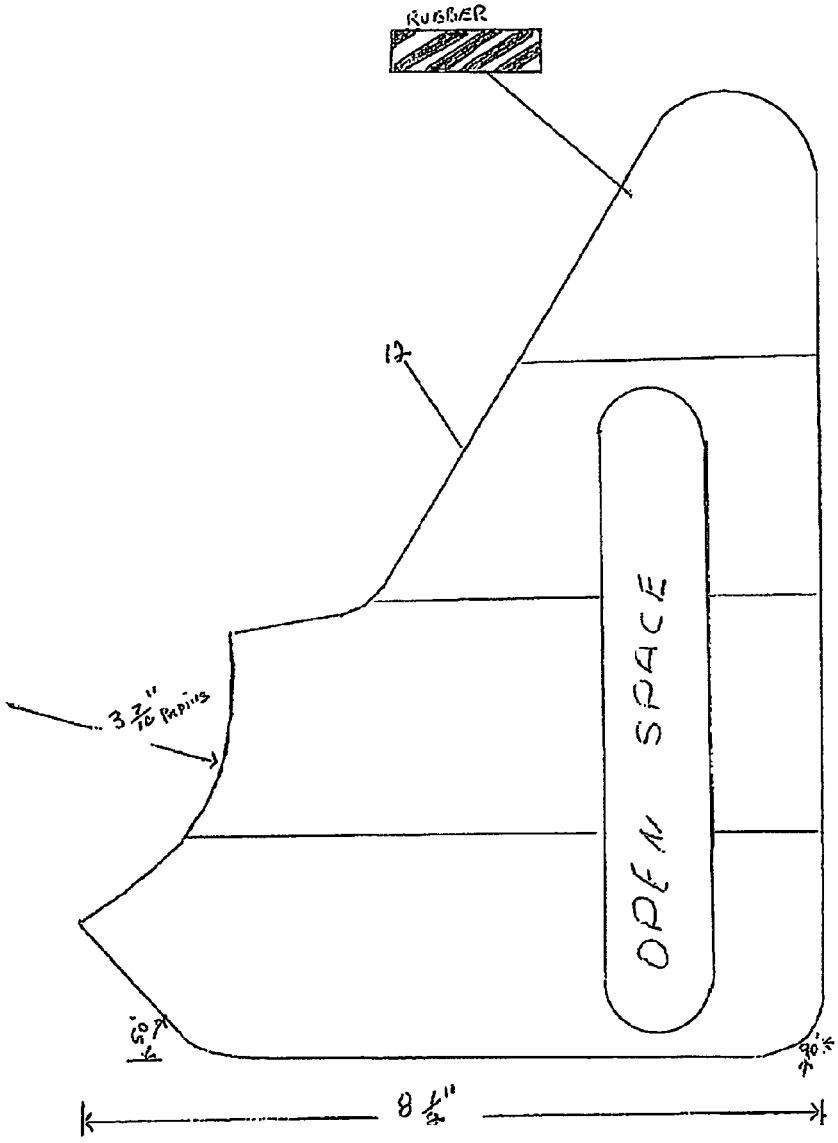
FIG. 9 shows a side view of the outer rubber cover in accordance with the principles of the present disclosure.
Figure 9A:
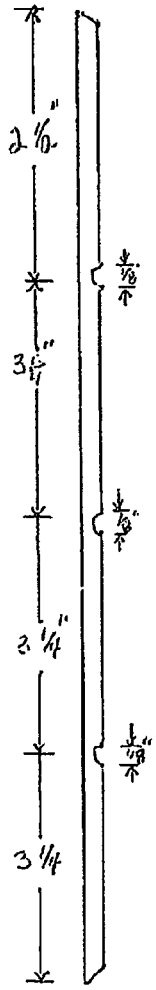
Figures 10A, 10B:
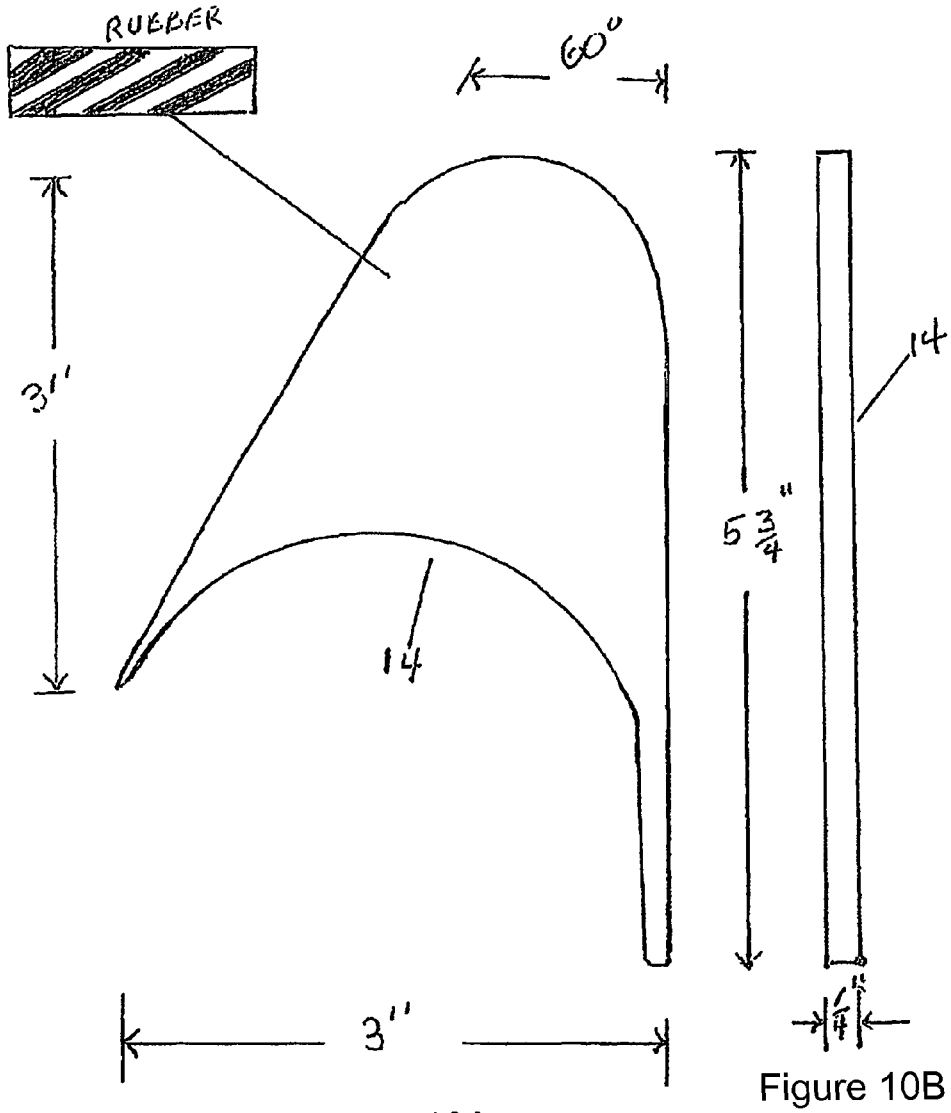
FIGS. 10A and 10B show an inner cover view in accordance with the principles of the present disclosure.

FIG. 9 is directed to the outer rubber cover 12 for covering the outer surface of both tower plates 10 under the handle 11. The outer rubber 12 comprises a section for the nameplate. Also each tower plate includes an inner cover 14, as shown in FIG. 10. The inner cover 14 is located and fastened to each tower plate inner surface just under handle 11 and above the forearm rest 9.

Figure 11:
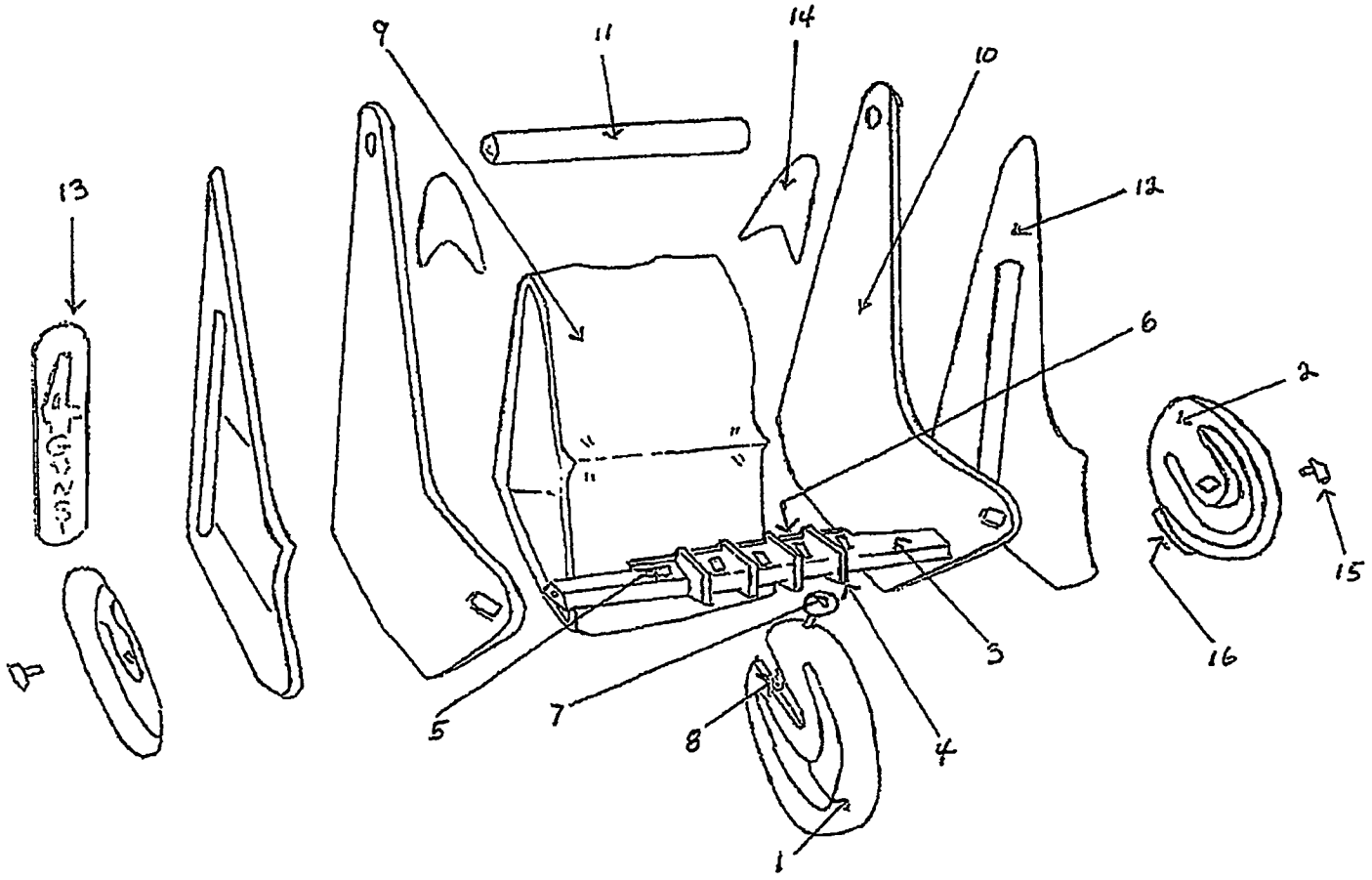
FIG. 11 shows a front explode view of the dumbbell system inner cover view in accordance with the principles of the present disclosure.

FIG. 11 is directed to a front perspective exploded view comprising the handle grip 11, forearm rest 9 with indentation, the floating ring rack 3 and the tower plates 10. The two tower plates 10, holds the whole mechanism together in place, as disclosed in FIG. 6 and adding the inner cover 14 and outer cover 12, to complete the unit. While getting the pieces together the portion of floating ring rack 3 protrudes outside of tower plates 10 and outer cover 12. A name plate 13 is the emblems inserted inside the space provided by the outer cover 12.

Further the stationary floating ring 2 is located at both sides of floating ring rack 3. The stationary floating ring 2 are held in place by second end cap comprising screws, wherein said second end caps will be screwed on said floating ring rack 3 prevent the stationary floating ring 2 from coming off. The second hard rubber pad 16 of said stationary floating rings 2 raises the whole dumbbell system off the ground, giving clearance so sliding floating rings 1 can slide in and out.

The present disclosure provides at least five sliding floating rings 1 for the dumbbell system, and one or two on the outside of tower plates 10 depending if we use second end cap 15 or first end cap 17. Second end cap 15 allow two stationary floating rings 2 on the outside of tower plates 10 because of its' reduce size. To separate this sliding floating ring 1 the preferred embodiment provide separators 4 which are ring separators, allows each sliding floating rings 1 to have its own separate spot, and will not be move all about. In the inner sides of floating ring rack 3 and forearm rest 9 is located a hard rubber backing pad 6. This is to lessen the noise after sliding floating ring 1 is placed on top of floating ring rack 3, wherein the locking pin 8 is pushed down to prevent sliding floating ring 1 from having a clanking noise. In addition, the floating ring rack 3 comprises five pads on the top surface of floating ring rack 3 these are friction pads 5, as mentioned above. This allows sliding floating ring 1 to slide in and out and prevents metal-to-metal contact as they slide in and out smoothly.

Figure 12A:
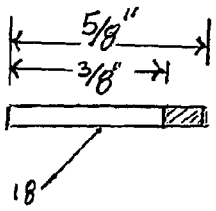
FIG. 12 shows a general view of the locking pin in accordance with the principles of the present disclosure.
Figure 12B:
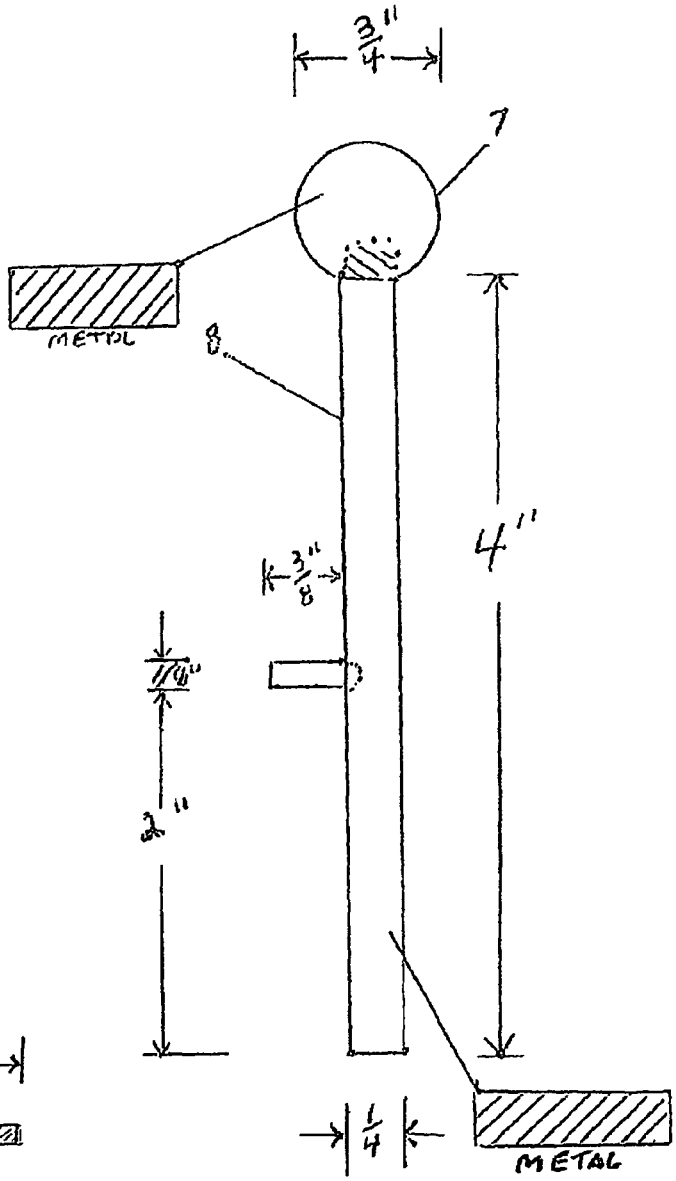

FIG. 12 is directed to the locking pin 8, wherein said locking pin 8 as explained above, secures sliding floating ring 1 from sliding out while in use. In locking pin 8 there is a small adjustment pin 18 that screws into the main locking pin 8. The adjustment pin 18 restricts the travel of locking pin 8 so not to be pulled out of the top of sliding floating ring 1. There is a groove cut out in sliding floating ring 1 to accommodate the travel of the adjustment pin 18.

Figure 13B:
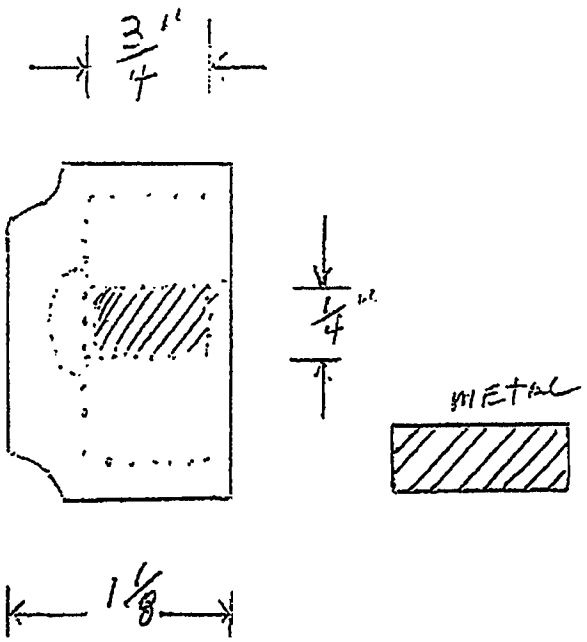
FIGS. 13A and 13B show general views of the first end caps in accordance with the principles of the present disclosure.
Figure 13A:
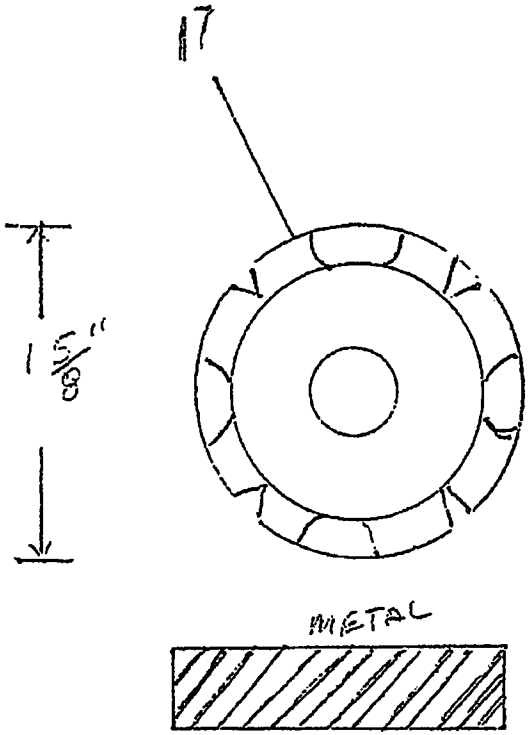
Figure 14B:
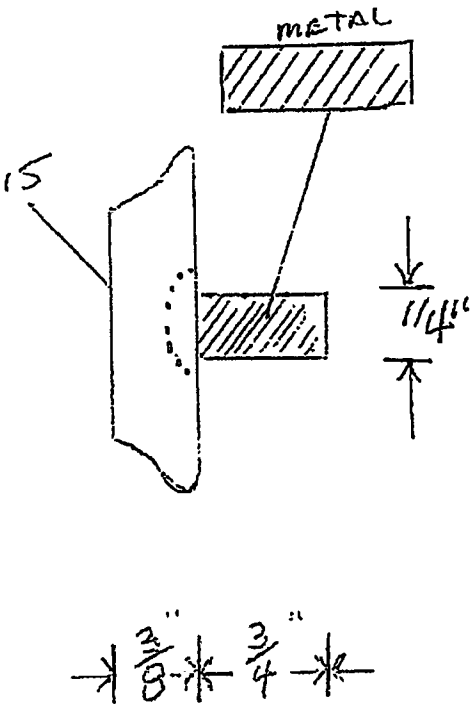
FIGS. 14A and 14B show general views of the second end caps in accordance with the principles of the present disclosure.
Figure 14A:
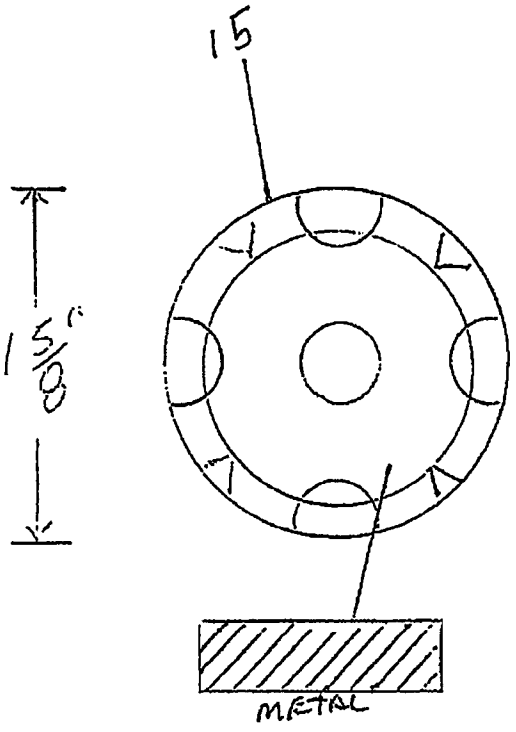

FIG. 13 and FIG. 14 are directed to the end caps 15, 17. The first end cap 17 holds stationary floating rings 2 in place after assembling of the dumbbell system elements. These first end caps, allows only one floating ring on the outside of Item 10. The second end cap 15 holds the outer floating ring in place. Instead of one floating ring, second end cap 15 allows two floating rings to be placed on the outside of tower plates 10 because of its narrow size.

Figures 15A, 15B:
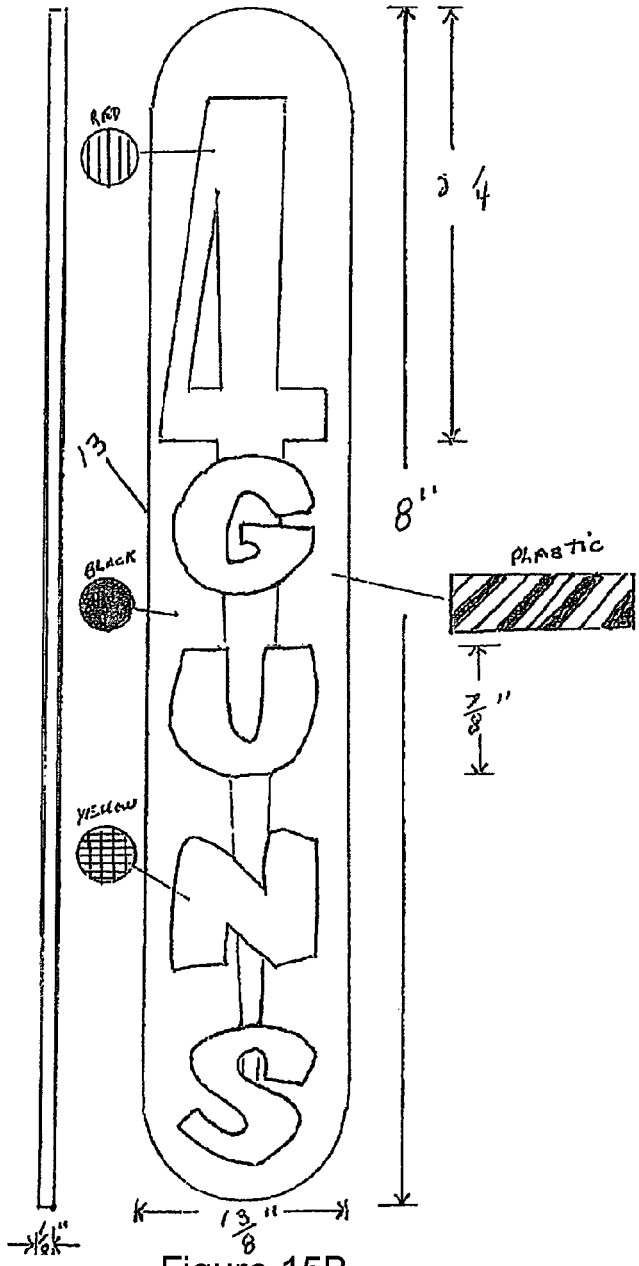
FIGS. 15A and 15B show general views of the name plate in accordance with the principles of the present disclosure.
Figure 16:
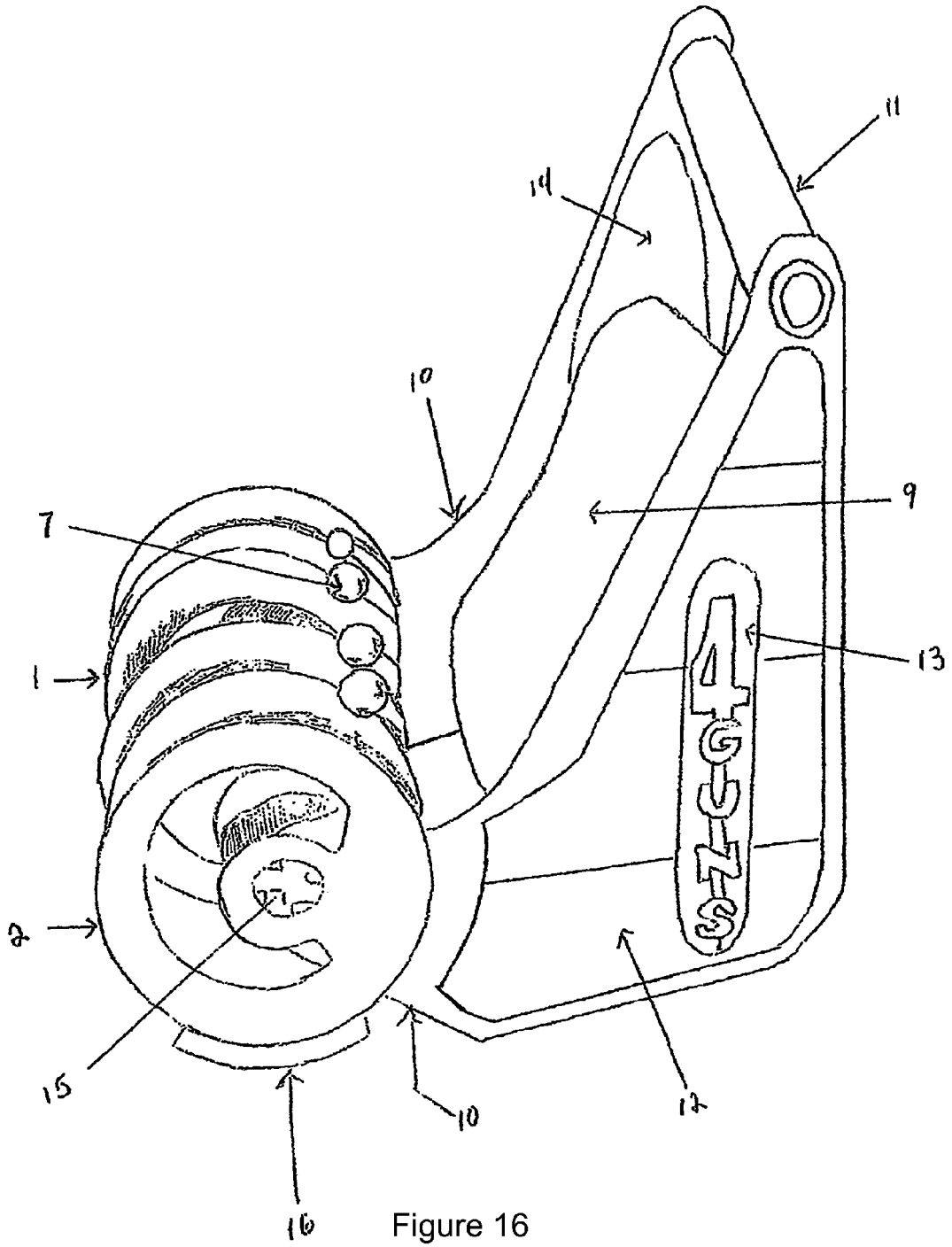
FIG. 16 shows a perspective view of the dumbbell system assembled in accordance with the principles of the present disclosure.
Figure 17:
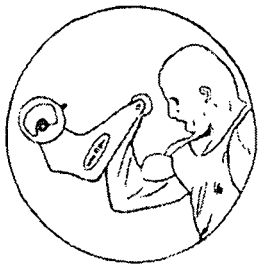
FIG. 17 shows a exemplary embodiment of a person using the dumbbell system assembled in accordance with the principles of the present disclosure.

Further FIG. 15 is directed to the name plate 13, wherein said name plate is located on the space provided in the center of outer cover 12. FIG. 16 discloses a fully assembled view of the preferred embodiment for the dumbbell system completely assembled and ready to use. FIG. 17 shows an exemplary embodiment of a person using the dumbbell system assembled in accordance with the principles of the present disclosure.

The invention claimed is:

1. An dumbbell system comprising:

a handle, wherein said handle comprises a first handle distal end and a second handle distal end;

at least a first floating ring;

a floating ring rack comprising a middle rack surface, a first rack distal end and a second rack distal end;

a forearm rest member;

at least a first tower plates and a second tower plate;

wherein said first tower plate comprises a first top hole and a first bottom recess;

wherein said second tower plate comprises a second top hole and a second bottom recess;

wherein said forearm rest member is located between the first tower plate and said second tower plate;

wherein said floating ring rack is located between the first tower plate and said second tower plate, wherein said first rack distal end is inserted through said first bottom recess and a second rack distal end is inserted through said second bottom recess;

wherein said handle is located between the first tower plate and said second tower plate; wherein said first handle distal is coupled to the first top hole and said second handle distal end is coupled to said second top hole; and wherein said first floating ring can slide in and out of said middle rack surface.

2. The dumbbell system, as claimed in claim 1, wherein said first floating ring comprises a locking pin, wherein said locking pin is configured to couple the middle rack surface for holding the first floating ring on said floating ring rack.

3. The dumbbell system, as claimed in claim 1, wherein said middle rack surface comprises separators and friction pads.

4. The dumbbell system, as claimed in claim 1, comprising at least a pair of second floating rings.

5. The dumbbell system, as claimed in claim 4, wherein said first rack distal end protrudes from said first tower plate; wherein second rack distal end protrudes from said second tower plate; and wherein; and wherein at least one of the pair of second floating rings is attached to the second rack distal end.

6. The dumbbell system, as claimed in claim 5, wherein the forearm rest member comprises an indentation.

* * * * *